US010323507B2

(12) United States Patent
Wayne et al.

(10) Patent No.: US 10,323,507 B2
(45) Date of Patent: Jun. 18, 2019

(54) APPARATUS, SYSTEM AND METHOD FOR MULTI ZONE MONITORING IN BOREHOLES

(71) Applicant: GAS SENSING TECHNOLOGY CORP., Laramie, WY (US)

(72) Inventors: Mike Wayne, New Farm (AU); Stuart Leach, Camp Hill (AU)

(73) Assignee: GAS SENSING TECHNOLOGY CORP., Laramie, WY (US)

( * ) Notice: Subject to any disclaimer, the term of this patent is extended or adjusted under 35 U.S.C. 154(b) by 0 days.

(21) Appl. No.: 15/856,473

(22) Filed: Dec. 28, 2017

(65) Prior Publication Data

US 2018/0119542 A1 May 3, 2018

Related U.S. Application Data

(62) Division of application No. 14/476,867, filed on Sep. 4, 2014, now Pat. No. 9,885,233.

(60) Provisional application No. 61/876,190, filed on Sep. 10, 2013.

(51) Int. Cl.
*E21B 47/06* (2012.01)
*E21B 33/124* (2006.01)

(52) U.S. Cl.
CPC ..... *E21B 47/06* (2013.01); *E21B 33/1243* (2013.01)

(58) Field of Classification Search
CPC ..... E21B 47/06; E21B 47/01; E21B 47/122; E21B 33/12; E21B 17/00; E21B 17/003; E21B 17/02; E21B 17/10
See application file for complete search history.

(56) References Cited

U.S. PATENT DOCUMENTS

2001/0050172 A1* 12/2001 Tolman ..... E21B 17/203 166/297

* cited by examiner

*Primary Examiner* — Wei Wang
(74) *Attorney, Agent, or Firm* — Adolph Locklar

(57) ABSTRACT

A multi-zone monitoring system allowing simultaneous measurement of separate zones of multi-zone wellbore formations comprising a multi-component umbilical containing both electrical lines and a hydraulic fluid lines, an inflatable isolation packer that can traverse through the wellbore and be inflated with hydraulic fluid to seal off a portion of the wellbore wherein the inflatable isolation packer is connected to a hydraulic line of the multi-component umbilical, wherein the inflatable isolation packer further comprises: one or more cable bypass feed throughs for the umbilical's electric and hydraulic fluid lines, wherein the hydraulic line is attached to the inflatable isolation packer with compression fittings. A method of monitoring geologic formations in a wellbore comprising attaching a plurality of inflatable isolation packers at predetermined distance to an umbilical containing a hydraulic line for inflating each packer, monitoring each connection of the hydraulic line to each inflatable isolation packer, attaching monitoring equipment to the umbilical at predetermined distances to the umbilical, lowering the equipment and inflatable isolation packers down a wellbore using the umbilical, and monitoring the equipment and each hydraulic line connection at a surface.

17 Claims, 5 Drawing Sheets

APPARATUS, SYSTEM AND METHOD FOR MULTI ZONE MONITORING IN BOREHOLES

RELATED APPLICATIONS

This application is a divisional application which claims priority from U.S. utility application Ser. No. 14/476,867, filed Sep. 4, 2014, which is itself a nonprovisional application that claims the benefit of and priority to Provisional Application entitled Apparatus, System and Method for Multi Zone Monitoring in Boreholes filed Sep. 10, 2013, assigned application Ser. No. 61/876,190 and which is incorporated by reference herein in its entirety.

FIELD OF THE DISCLOSURE

The invention relates to an apparatus, system and method for deploying, suspending, retrieving and monitoring multiple downhole logging tools, positioned between zonal isolation packers, from a surface deployment unit. In particular, the invention relates, but is not limited, to isolating multiple separate geological formations penetrated by a single borehole and monitoring the pressure and temperature of the fluid-filled pores in each formation.

BACKGROUND TO THE DISCLOSURE

Reference to background art herein is not to be construed as an admission that such art constitutes common general knowledge.

Borehole monitoring, particularly across multiple zones (e.g. two to 10+), is a relatively complicated, time consuming, and expensive operation. Heavy tubing deployed systems, typically connected to a surface control and measurement system using electric and hydraulic control lines strapped to the tubing, along with an expensive drilling or workover rig, have been known to be used for such borehole monitoring operations. An expensive drilling or workover rig typically includes a frame that provides support for various components such as a drill head support structure, which would usually include a drill string capable of drilling a borehole.

One aspect of borehole monitoring that is identified as being particularly onerous is the requirement of a drilling rig and heavy duty tubing to deploy and retrieve any monitoring system. Typically the borehole pressure and temperature is monitored by drilling a borehole and installing some form of tubing in the hole. At the required depths of the tubing, special tools such as isolating packers and pressure/temperature sensors are attached as required. Typically an electrical cable is installed with the tubing to provide telemetry to the sensors and a hydraulic cable is also installed to provide inflation control to the isolation packers.

Once the monitoring system has gathered all the required data, however, the monitoring system, isolating system and tubing must then be retrieved. Typically, system retrieval involves the use of a drilling rig. The time and cost associated with recovering the monitoring systems in this manner renders multi-zone borehole monitoring impractical for non-permanent applications.

Some efforts have been made to reduce the problems, such as by using battery powered sensors that record data to a local memory device and which are deployed on solid wire spooled off wireline units and surface winches without the requirement for a drilling rig. Pressure readings can then be obtained at any depth of the borehole without having to install or retrieve a tubing string. However this technique does not provide for real time data, or the ability to isolate various zones or sections of the borehole, and so is not suited for applications requiring continuous monitoring of borehole or geological properties in a multi-zone setting.

A further problem with isolating and monitoring these zones is associated with legislation requirements for abandoning old boreholes. Typically the isolating packers used are expensive tubing mounted devices that are not capable of being retrieved due to their mechanical setting design and that often require use of drilling rigs with expensive specialist equipment to remove these devices from the borehole and satisfy legislation requirements.

Having a borehole isolating and monitoring system which can be deployed, suspended and retrieved from a portable surface winch is therefore an attractive yet unavailable system. It is desirable to be able to deploy a plurality of sensors at different depths in order to isolate the borehole sections above and below each sensor. The sensors could be powered from an autonomous surface cabinet that could also display and record real-time data. The provision of surface electrical power would eliminate the need for battery powered downhole sensors, which otherwise would need to be retrieved periodically to recharge or replace the batteries.

OBJECT OF THE DISCLOSURE

It is an aim of this invention to provide an apparatus, system and method for deploying, suspending and retrieving a multi-zone borehole monitoring system from a portable surface winch which enables economical, regulatory-compliant downhole monitoring, real time data collection, and eventual retrieval.

Other preferred objects of the present invention are apparent from the following description.

SUMMARY OF DISCLOSURE

According to a first aspect of the disclosure, there is provided a retrievable, multi-zone downhole monitoring system for use in multi-zone borehole operations, the downhole monitoring system comprising:

At least one downhole measuring instrument comprising electronic components including sensors transmitting real time data to surface; and At least one pressure isolation packer that can be actuated from surface to provide a borehole seal;

a control and suspension umbilical comprising power and telemetry electrical cables for the sensors, a hydraulic inflation line for the packers and means of conveyance into the borehole;

pressure-testable sealed connectors to attach the control and suspension umbilical to the pressure isolation packer; and a suspension hang off apparatus comprising umbilical slips to suspend the system and umbilical exiting ports;

wherein the measuring instruments include at least a pressure sensor or a temperature sensor, and the isolation packer is actuated from a surface to provide zonal isolation across each sensor.

Hereinafter, such a downhole measuring instrument and companion pressure isolation packer will be referred to as a zonal isolation module.

The isolation packers can include pressure rated connections to allow all hydraulic and electrical lines to bypass through each packer. It will be appreciated that the environment of a borehole may contain significant pressure, particularly due to hydrostatic pressure of borehole fluid at a significant depth in the well. This can cause infiltration of fluids into the electrical wires and hydraulic fluid lines. The connectors are preferably located above and below each packer. Even more preferably the connectors are capable of being pressure tested prior to deployment to ensure pressure integrity. Even more preferably the connectors may provide a tertiary weak point to allow for emergency disconnect capabilities by means ensuring the connectors break from an applied tensile load less than the maximum tensile strength of the umbilical and other components.

Preferably the system is connected to a multi-core downhole umbilical on a portable winch at the surface. The multi-core downhole umbilical can be spooled into the borehole to deploy the system to the required depth. The multi-core or wire downhole umbilical allows more than one instrument or sensor to be connected to the umbilical cord. The portable winch provides a depth counter and slip ring to capture sensor measurements and attribute them to precise depths while running (raising and lowering) in the hole.

Preferably the downhole umbilical components include a data transfer system in communication with the measuring instruments and a hydraulic system for inflating and deflating the isolation packers. The downhole umbilical also provides sufficient tensile strength to accommodate the total number of packers and sensors required.

The downhole monitoring system may further comprise measuring instruments to diagnose well integrity such as vibration or chemical composition of the fluids between each isolation packer.

Preferably the downhole measuring instruments comprise a mating portion that secures to a corresponding mating portion of the downhole umbilical. Preferably the downhole tool contains the sensors, the data transfer system, and the power system. The downhole tool could be actuated from a surface control unit to retrieve real time data.

The surface control unit may comprise data storage for storing data received from the sensors. The data transfer system may store the data for transmission at a requested time. The control unit also provides power to the downhole tool and hydraulic pressure for the isolation packers.

The portable surface winch is used to lower the downhole monitoring system through the borehole, preferably to total depth, and suspend the monitoring system by a portion of the downhole umbilical, preferably at a well head. Preferably at least a portion of the downhole umbilical protrudes from the wellhead to allow a portable surface winch to recover the system from the borehole at the end of the monitoring period.

Further features and advantages of the present invention will become apparent from the following detailed description.

BRIEF DESCRIPTION OF THE DRAWINGS

The accompanying drawings, which are incorporated in and constitute a part of the specification, illustrate preferred embodiments of the disclosure. These drawings, together with the general description of the disclosure given above and the detailed description of the preferred embodiments given below, serve to explain the principles of the disclosure. By way of example only, preferred embodiments of the disclosure will be described more fully hereinafter with reference to the accompanying figures.

DETAILED DESCRIPTION OF THE DISCLOSURE

Figure 1:
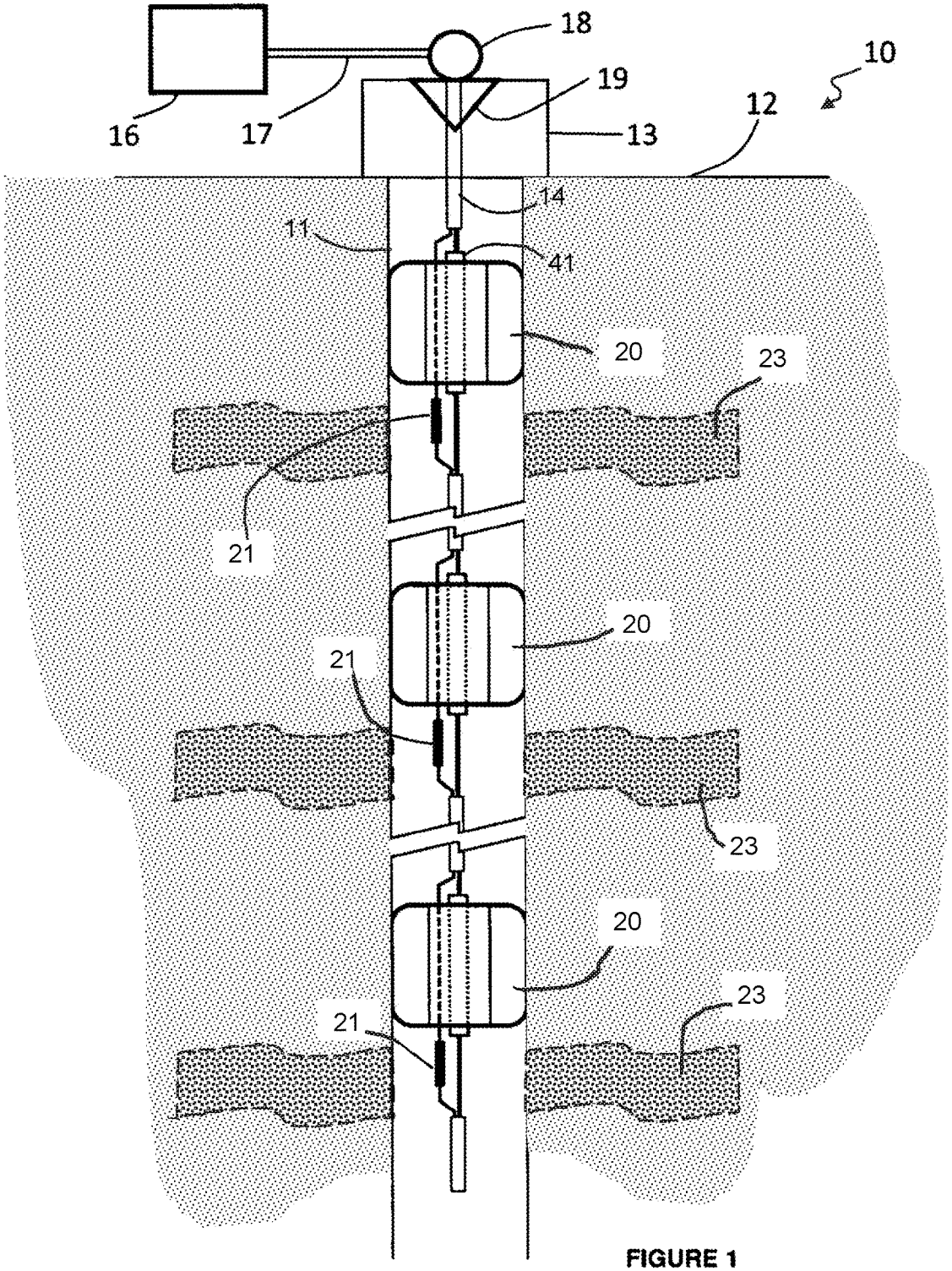
FIG. 1 is a diagrammatic view of a multi-zone monitoring system suspended in a borehole.

FIG. 1 illustrates a diagrammatic view of a multi-zone downhole monitoring system 10 located in a borehole 11 below surface 12. The multi-zone downhole monitoring system 10 may be located at various depths below surface 12, but typically the borehole 11 will be greater than 50 m below surface 12 and, in many cases, approximately 1000 m below surface 12.

The multi-zone downhole monitoring system 10 has a wellhead 13 located at the top of the borehole 11 for equipment suspension and well control. The umbilical 14 provides the monitoring system 10 with power, control, and telemetry. Typically the monitoring system 10 is powered and operated at surface 12, via surface cable 17, and umbilical 14, from the surface control unit 16. Although the surface control unit 16 is illustrated as being located on the surface adjacent to the borehole 11, it will be appreciated that the surface control unit could also be located elsewhere, such as a control office.

The multi-zone downhole monitoring system 10 has a wellhead outlet 18 connected to the wellhead 13 at the surface of the borehole. The wellhead outlet provides a sealable barrier between the borehole 11 and surface 12 allowing hydraulic and electrical connections to be connected between the downhole umbilical 14 and surface cable 17. During suspension, the wellhead 13 uses a wellhead suspension apparatus "slips" 19, known in the industry, to lock the umbilical in place and hold the weight of the monitoring system 10. At pre-specified intervals, i.e., length separation, multiple isolation packers 20 are attached to the umbilical 14 to provide barriers between different geological formations 23 intersected by the borehole. Typically there may be any number of formations 23 between one to ten. Between each isolated formation 23, downhole measuring instruments 21 are attached to the umbilical to provide real time data (typically pressure and temperature) from each isolated zone 23. Other measurements may be taken, e.g. gas partial pressure in fluid. During monitoring operations, the isolation packers 20 are inflated to create sealing barriers between each formation while the measuring instruments monitor various formation fluid and well parameters. The monitoring information can be conveyed through the wires of the umbilical to the surface.

Figure 2A:
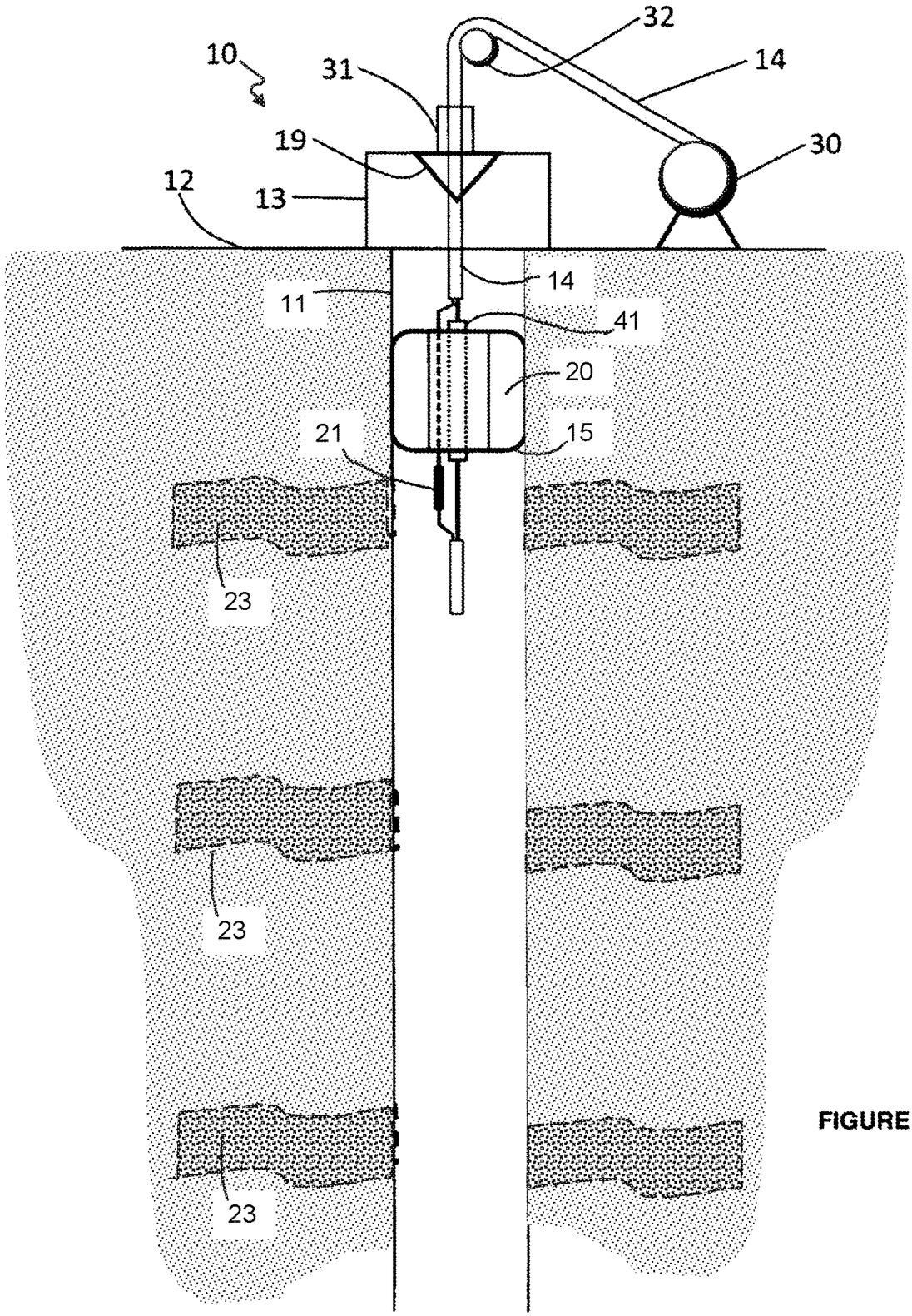
FIG. 2*a* is a diagrammatic view of a portable surface winch lowering a monitoring system into a borehole on the downhole umbilical.

FIG. 2*a* illustrates a diagrammatic view of the multi-zone monitoring system 10 being deployed at surface 12 into the borehole 11. An isolation packer 20 and measuring instruments 21 are connected to the umbilical 14 at surface 12. This array comprises an integral zonal isolation and monitoring module 15. The integral zonal isolation and monitoring module 15 is then lowered through the wellhead 13, and possibly a well control valve 31 into the opening of the borehole 11 using the portable winch 30 at surface. The umbilical is configured from the portable winch 30 over a pulley 32 above the wellhead 13 to allow smooth deployment into the borehole 11. The portable winch 30 is used to lower the integral zonal isolation and monitoring module 15 into the borehole 11 to a depth equal to that between the deepest two zones requiring isolation 32. The hydraulic line contained within the umbilical is also in communication with a hydraulic pump for the inflation and deflation of the inflatable isolation packers that forms part of the surface control unit 16. Once the first integral zonal isolation module is at a depth equal to that between the deepest two zones requiring isolation 32, the umbilical 14 is suspended in the slips 19 and cut to allow the installation of another integral zonal isolation and monitoring module 15 on the umbilical 14. The subsequent integral zonal isolation module 15 is connected to the cut umbilical 14 using compression fittings 40 and a pressure testable sealed connector 41 (see FIG. 3) before removing the slips 19 and continuing with the deployment of the multi-zone system.

Figure 2B:
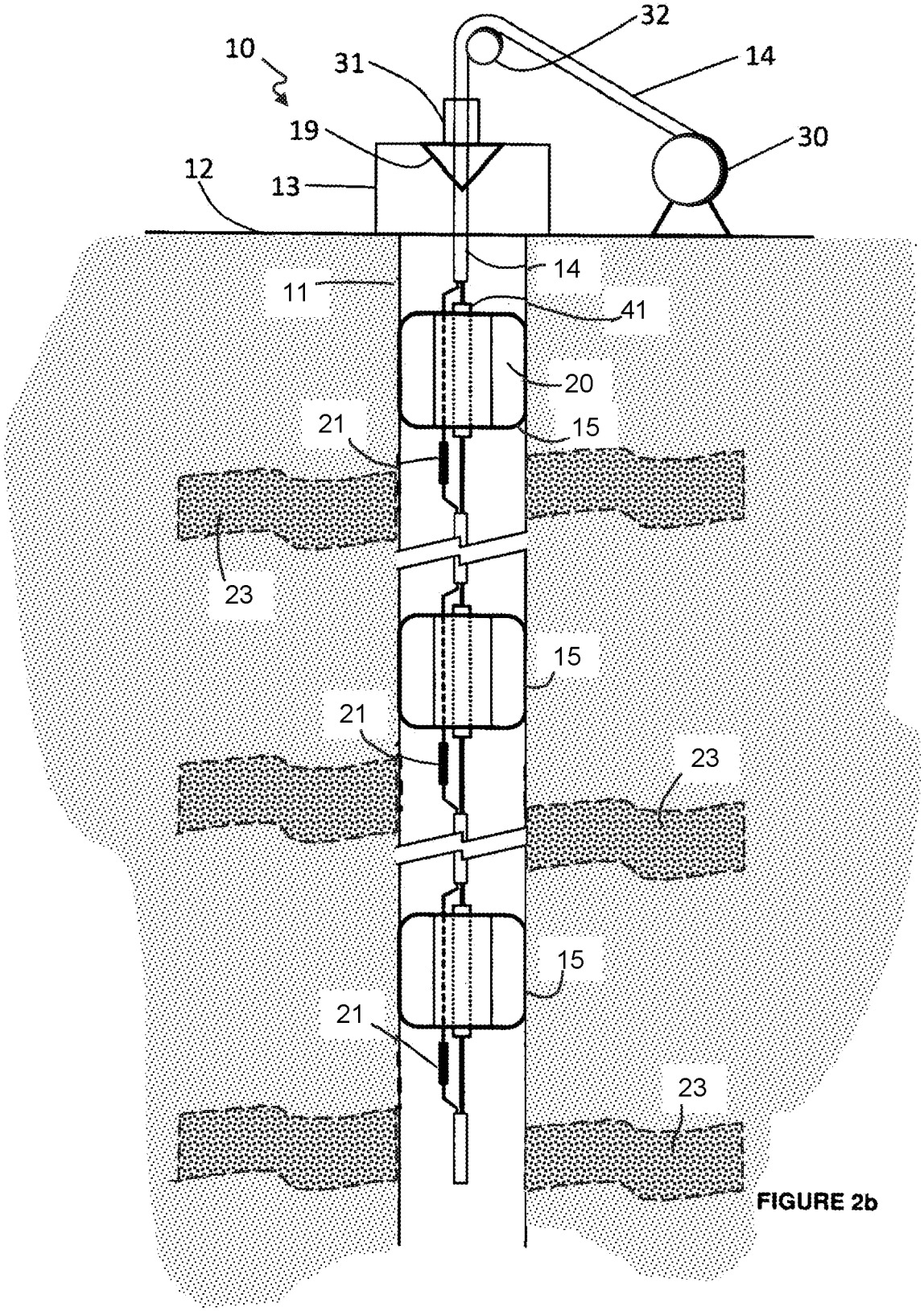
FIG. 2*b* is a diagrammatic view of a multi-zone monitoring system being lowered to total depth into a borehole.

FIG. 2*b* illustrates a diagrammatic view of the multi-zone downhole monitoring system 10 having been deployed to total depth into the borehole 11. The steps as detailed in the description of FIG. 2*a* are repeated as required to position a sequence of integral zonal isolation and monitoring modules 15 between the target formations 23 of the borehole 11. Each integral zonal isolation and monitoring module 15 is connected to the umbilical 14 at surface with the distance between each system matching the distance between each target formation 32. Once the entire multi-zone downhole monitoring system 10 is installed in the borehole at the appropriate total depth, the umbilical 14 is severed at surface 12. The umbilical 14 is suspended in the slips 19 at the wellhead 13 allowing for the weight of the multi-zone system to be suspended at the point of the slips without dropping into the hole. FIG. 1 shows that the top of the hydraulic line 50 and electrical cable 51 (see FIG. 3) in the severed umbilical 14 are connected at the wellhead outlet 18 to establish communication from the surface control unit 16 to the monitoring system, via surface cable 17. It will be appreciated that the monitoring equipment of the system can be positioned on the umbilical proximate to a geologic formation intersected by the wellbore.

Figure 3:
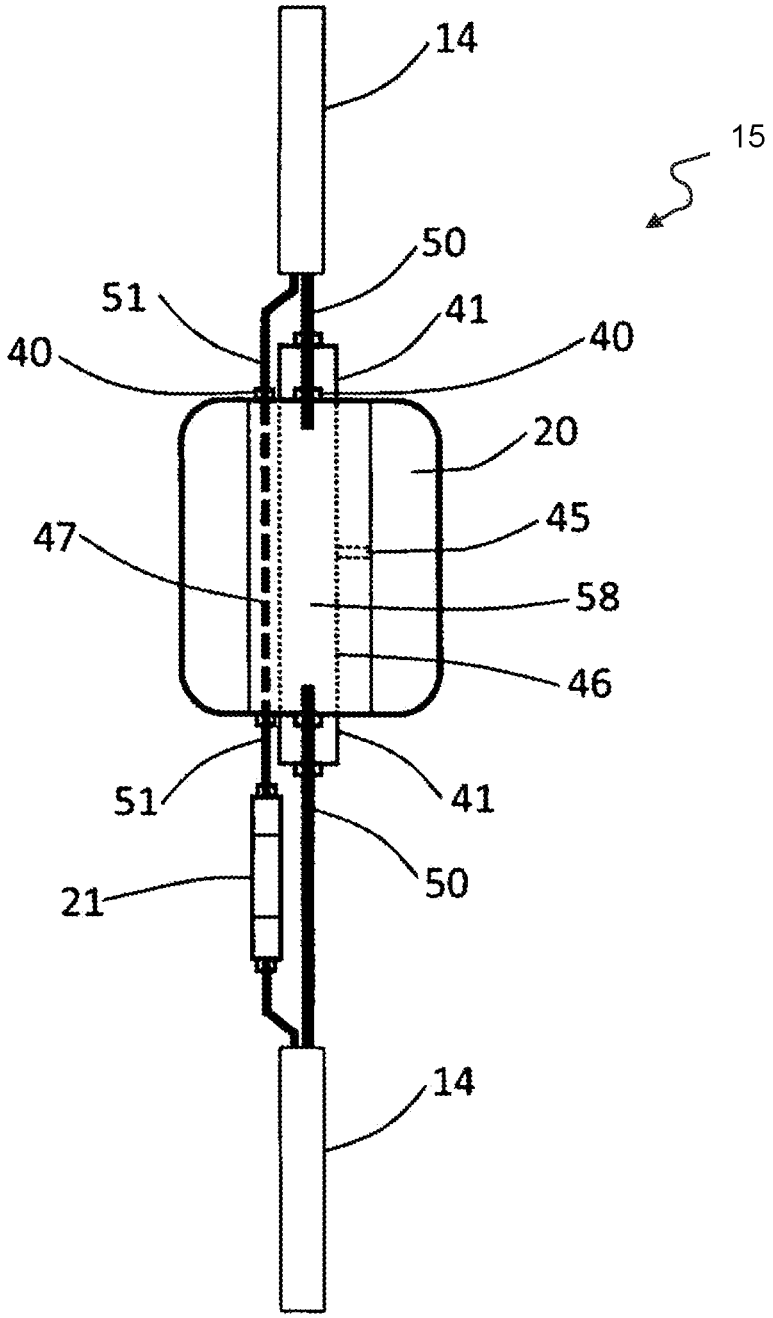
FIG. 3 is a diagrammatic view of an integral zonal isolation module comprising an isolation packer and downhole monitoring instrument.

FIG. 3 illustrates a preferred integral zonal isolation and monitoring module 15. The integral zonal isolation and monitoring module 15 has an isolation packer 20 in the form of an inflatable, pressure sealing elastomic bladder inflated and shaped to seal or "pack-off" the internal diameter of the borehole 11 in FIG. 1. The integral zonal isolation and monitoring module 15 has an inner mandrel 46 to provide a cylindrical shaft and bore through the center of the isolation packer to provide for a base for the isolation packer 20, a hydraulic chamber 58 and inflate port 45 for inflation of the isolation packer 20 and contains one or more cable bypass feed throughs for the umbilical's 14 electric cable 51. The inner mandrel 46 may also provide the ability for a "shear-release" functionality as a secondary method of deflation. The shear-release function would allow for the inner mandrel to shear under a determined applied load and therefore release the stored pressure in the packer allowing it to deflate. Located at the top and bottom of the inner mandrel 46 are compression fittings 40 and pressure testable sealed connectors 41 to provide sealed connections between the umbilical's 14 hydraulic line 50 and the inner mandrel 46. The sealed connections 41 provide a pressure barrier to ensure pressure can be applied directly to the isolation packer's inflate port 45 and monitored at surface to ensure there is no pressure leak, this also provides the ability for the isolation packer to maintain its required inflate pressure for the life of the system without pressure leaks, further, the ability to pressure test these connections at surface provides confidence to the systems integrity prior to deployment down a borehole. The isolation packers are inflated by use of a common hydraulic line 50 in the umbilical 14. When hydraulic pressure is applied from the surface control unit 16 (see FIG. 1) to the line 50, all isolation packers are inflated to create a barrier seal against the bore hole walls.

The umbilical 14 also houses electrical cable 51 for the monitoring sensors, i.e., instruments. Typically, a multi zone system shall require between one to ten separate electrical cable 51 to power and transmit data from the measuring instruments 21. The electric cable 51 are routed through the inner mandrel 46 using cable feed through bypass 47 and the bypasses are sealed using compression fittings 40 above and below.

Figure 4:
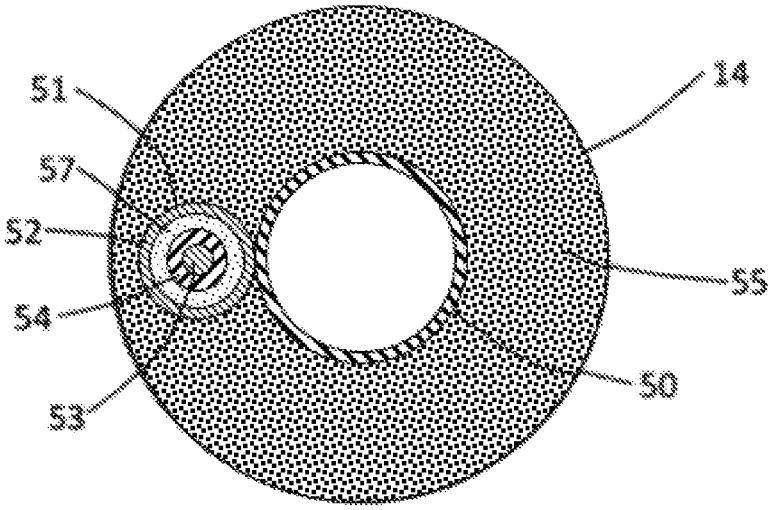
FIG. 4 is a cross-sectional view of a downhole umbilical

FIG. 4 illustrates a cross-sectional view of preferred downhole umbilical 14. The umbilical 14 has capacity to house all the required control lines for the monitoring system 15. The electrical cable 51 is used to supply electrical power and real time data transmission from the monitoring sensors 21 (See FIG. 2*b*). The electrical cable 51 has a core conductor 53, a core insulation 54, a filler 57 and is constructed within a single metal tube 52. The hydraulic line 50 is used to supply a common hydraulic pressure to each of the isolation packers 20. The hydraulic line 50 is a single metal tube which provides a polished surface for a compression fitting. The umbilical 14 shall also comprise some form of protection 55 such as a rubber or thermoplastic to protect against downhole environments.

Figure 5:
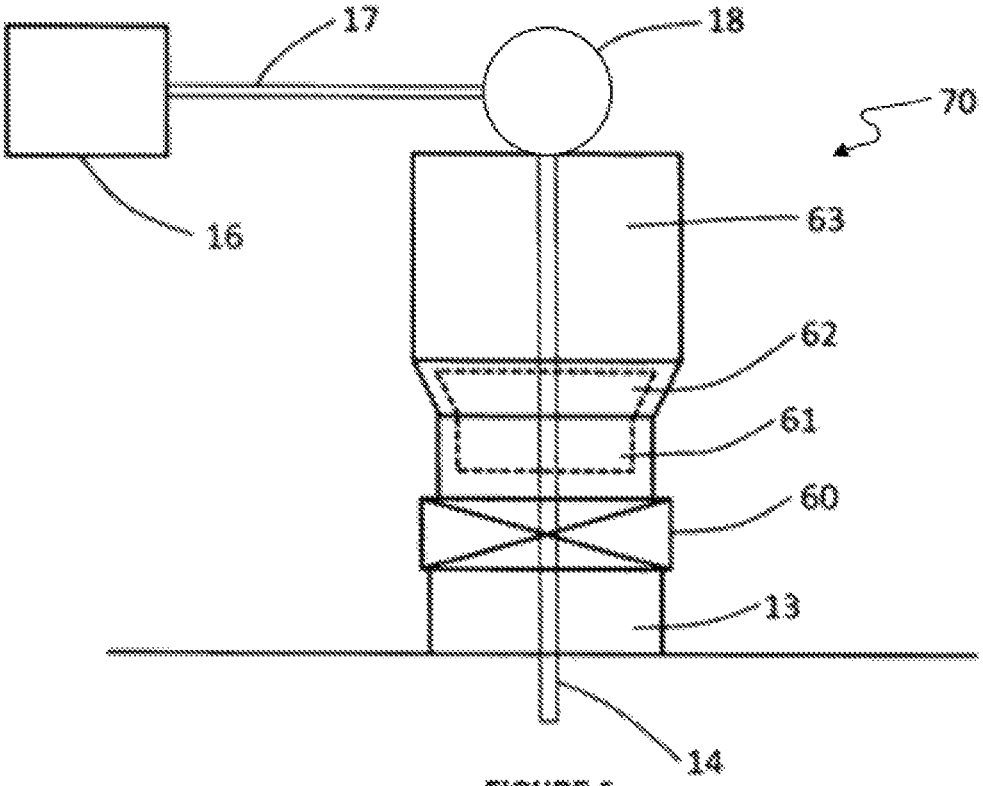
FIG. 5 is a diagrammatic view of the wellhead suspension apparatus

FIG. 5 illustrates a diagrammatic view of the wellhead suspension system 70 to provide well control and umbilical suspension cap. The multi-zone downhole monitoring system exits the wellbore through a well head or flange system 13, and a Blow Out Preventer (BOP) 60 or similar well control device is used to provide a barrier between the wellbore surface. The BOP seals around the downhole umbilical 14 and allows the umbilical to be suspended in the well by means of an umbilical clamp or hang-off plate 61 situated in a hang-off sub 62. Preferably the hang-off plate 61 is bolted or clamped around the outer diameter of the umbilical 14 and prevents any slippage of the umbilical 14 and attached monitoring system. The wellhead suspension system also has an end cap sub 63 to allow the umbilical to be terminated to an electrical wellhead outlet 18 and provide the necessary barriers to ensure all possible leak paths from the well are sealed. A surface cable 17 is terminated to the umbilical 14 in the wellhead outlet 18. The surface cable 17 is then tied into the surface control unit 16 for data capture and further telemetry if required.

This specification is to be construed as illustrative only and is for the purpose of teaching those skilled in the art the manner of carrying out the disclosure. It is to be understood that the forms of the disclosure herein shown and described are to be taken as the presently preferred embodiments. As already stated, various changes may be made in the shape, size and arrangement of components or adjustments made in the steps of the method without departing from the scope of this disclosure. For example, equivalent elements may be substituted for those illustrated and described herein and certain features of the invention maybe utilized independently of the use of other features, all as would be apparent to one skilled in the art after having the benefit of this description of the disclosure.

While specific embodiments have been illustrated and described, numerous modifications are possible without departing from the spirit of the invention, and the scope of protection is only limited by the scope of the accompanying claims.

What we claim is:

1. A method of monitoring geologic formations in a wellbore comprising:

attaching a first integral zonal isolation and monitoring module to an umbilical, the first integral zonal isolation and monitoring module including a first isolation packer and a first measuring instrument;

lowering the first integral zonal isolation and monitoring module to a first depth in the wellbore above a first zone in the geologic formation;

attaching a second integral zonal isolation and monitoring module to the umbilical, the second integral zonal isolation and monitoring module including a second isolation packer and a second measuring instrument;

lowering a second integral zonal isolation and monitoring module to a second depth in the wellbore above a second zone in the geologic formation;

inflating the first isolation packer and the second isolation packer; and measuring using the first measuring instrument and the second measuring instrument.

2. The method of claim 1 further comprising after the step of measuring using the first measuring instrument and the second measuring instrument:

deflating the first isolation packer and the second isolation packer by control from the surface;

raising the isolation packers utilizing the umbilical; and removing the first isolation packer and second isolation packer from the wellbore.

3. The method of claim 1 further comprising after the step of lowering the first integral zonal isolation and monitoring module:

suspending the umbilical in slips at the surface.

4. The method of claim 3, wherein the second integral zonal isolation and monitoring module is connected to the umbilical using compression fittings and a pressure-testable sealed conductor.

5. The method of claim 1 further comprising after the step of lowering a second integral zonal isolation and monitoring module and before the step of measuring using the first measuring instrument and the second measuring instrument:

severing the umbilical at the surface; and connecting the severed umbilical to a wellhead outlet to establish communication between the first measuring instrument, the second measuring instrument, and a surface control unit.

6. The method of claim 5 further comprising communicating data from the first measuring instrument and the second measuring instrument to the surface control unit using the umbilical.

7. The method of claim 5 further comprising supplying power to the first measuring unit and the second measuring unit through the umbilical.

8. The method of claim 1, wherein the umbilical contains a hydraulic line, the hydraulic line connected to a hydraulic pump and the first isolation packer and the second isolation packers.

9. The method of claim 8, wherein the step of inflating the first isolation packer and the second isolation packer is performed using the hydraulic line.

10. The method of claim 1, wherein the steps of lowering the first integral zonal isolation and monitoring module and the second integral zonal isolation and monitoring module is performed by a winch.

11. The method of claim 10, wherein the winch is portable.

12. The method of claim 1, wherein the first measuring unit and the second measuring unit measure pressure, temperature, gas partial pressure in a fluid, or a combination thereof.

13. The method of claim 1, wherein the first isolation packer and the second isolation packer are elastomeric bladders.

14. The method of claim 1, wherein the first zonal isolation and monitoring module and the second zonal isolation and monitoring module each have a bore therethrough, a hydraulic chamber, and an inflate port.

15. The method of claim 14, wherein the first and second isolation packers are inflated through an inflation port.

16. The method of claim 15, wherein the pressure of the first and second isolation packers are monitored at the surface.

17. The method of claim 1 further comprising after the step of inflating the first and second isolation packers:

pressure testing the first and second isolation packers.

* * * * *